US006450779B1

(12) United States Patent
Schwing

(10) Patent No.: US 6,450,779 B1
(45) **Date of Patent: *Sep. 17, 2002**

(54) TWO-CYLINDER THICK MATTER PUMP

(75) Inventor: Friedrich Schwing, Gelsenkirchen (DE)

(73) Assignee: Schwing GmbH, Herne (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/485,164

(22) PCT Filed: Jul. 31, 1998

(86) PCT No.: PCT/EP98/04808

§ 371 (c)(1),
(2), (4) Date: Feb. 2, 2000

(87) PCT Pub. No.: WO99/09315

PCT Pub. Date: Feb. 25, 1999

(30) Foreign Application Priority Data

Aug. 13, 1997 (DE) ..... 197 35 091

(51) Int. Cl.[7] ..... F04B 9/00; F04B 7/00; F04B 53/10; F04B 39/10; F04B 15/02

(52) U.S. Cl. ..... 417/317; 417/518; 417/519; 417/531; 417/532; 417/900

(58) Field of Search ..... 417/900, 517, 417/518, 519, 531, 532, 533

(56) References Cited

U.S. PATENT DOCUMENTS

| | | | | | |
|---|---|---|---|---|---|
| 3,741,691 | A | * | 6/1973 | Schwing | 417/517 |
| 3,889,713 | A | * | 6/1975 | Bender | 137/625.48 |
| 3,963,385 | A | * | 6/1976 | Caban | 417/517 |
| 4,303,378 | A | * | 12/1981 | Hunter | 417/517 |
| 4,358,257 | A | * | 11/1982 | Seiler et al. | 417/517 |
| 4,580,954 | A | * | 4/1986 | Boyle | 417/517 |
| 5,024,584 | A | * | 6/1991 | Bordini et al. | 417/342 |
| 5,281,113 | A | * | 1/1994 | Simnovec | 417/519 |
| 5,330,327 | A | * | 7/1994 | Anderson | 417/53 |
| 5,360,321 | A | * | 11/1994 | Benckert et al. | 417/238 |

FOREIGN PATENT DOCUMENTS

| | | | |
|---|---|---|---|
| DE | 1 653 614 | | 8/1971 |
| DE | 20 09 964 | | 9/1980 |
| FR | 2 234 471 | | 1/1975 |
| FR | 2234471 | * | 1/1975 |

* cited by examiner

*Primary Examiner*—Charles G. Freay
*Assistant Examiner*—Timothy P. Solak
(74) *Attorney, Agent, or Firm*—Kinney & Lange, P.A.

(57) ABSTRACT

A two-cylinder thick-matter pump for continuous delivery of thick matter is characterized in that a reversing valve (5) has a diverter housing (8, 8') with at least four openings (a–b), the diverter (6, 6') disposed in the diverter housing (8, 8') is swiveled with its outlet opening in front of the cylinder openings and has an inlet opening (RE) which is firmly connected with the suction pipe (3), the cavity (H) in the diverter housing (8, 8') being constantly under delivery pressure, and at least one shut-off element (10) being provided for closing the suction pipe (3) and/or the first and/or second openings (a , b) of the diverter housing (8, 8').

15 Claims, 9 Drawing Sheets

SECOND STEP

THIRD STEP

TWO-CYLINDER THICK MATTER PUMP

BACKGROUND OF THE INVENTION

This invention relates to a two-cylinder thick-matter pump according to the preamble of claim 1.

Two-cylinder thick-matter pumps consist of two single pumps which are linked by circuit technology and synchronized in their motion sequence in such a way that while one cylinder (Z1) pumps the other cylinder (Z2) executes a suction stroke. Usually, the reciprocating speeds of the pistons are equal in both cylinders so that the ending times of the cylinder strokes (suction stroke and pumping stroke) coin-cide. The direction of motion of the cylinder pistons is reversed at the end of each stroke so as to effect constant alternation between pumping and suction strokes.

The suction stroke serves to convey thick matter such as concrete from a priming tank to the particular sucking cylinder. In the subsequent pumping stream the previously sucked-in material is urged out of the now pumping cylinder into the delivery pipe. To ensure that this process always takes place properly one usually provides one or more controllers or reversing valves—for example diverter valves or flat slide valves—which move back and forth between two end positions in order to establish the right connection between the cylinder openings, the delivery pipe connection and the priming tank.

Diverters, the currently most common controllers, are generally so disposed as to swivel back and forth between two end positions in which they establish the necessary connection between the cylinder openings, the delivery pipe connection and the priming tank. The diverter is constantly connected at one end with the delivery pipe while the other end covers the cylinder opening of the particular pumping cylinder. The cylinder opening of the sucking cylinder is thus open to the priming tank.

Since the reversing process of the diverter from one cylinder opening to the other cannot be effected at any desired speed, the flow of material in the delivery pipe is interrupted upon a change of stroke. This necessarily results in a discontinuous flow of material with problematic consequences such as acceleration shocks, surges, high mechanical loads on the components, oscillations in a possibly connected distributing boom, increased wear, etc.

Further adverse effects can prolong the flow interruptions further. For example one often observes the effect that the sucked-in thick matter is compressible because of its air or gas content. At the onset of the pumping stroke the thick matter must thus first be precompressed to the operating pressure prevailing in the delivery pipe before the flow of material commences. Depending on the kind of concrete and in accordance with the other operating conditions, however, the necessity of precompression can also be negligibly small.

Another kind of flow interruption is especially problematic, however. It results from the fact that diverters of the above-described kind and arrangement do not completely cover the delivery cylinder openings at the same time in the center position during their shifting motion (this effect being known as "negative cover"). The thick matter pressurized and prestressed in the delivery pipe can thereby flow back into the cylinder filled with as yet uncompressed thick matter, or past its opening into the priming tank (this effect being known as a "short circuit").

Altogether, the above-described effects lead to a considerable temporal interruption of the flow of material in the delivery pipe and possibly also to a considerable reduction of output due to return flow out of the delivery pipe. One can lessen the adverse effects by accelerating the shifting motion, but not completely eliminate them.

There is thus a desire to avoid interruptions in the flow of material and to deliver concrete continuously. The prior art already shows several attempted solutions for this but they are either insufficiently operable or involve unreasonable constructional effort making the pumps too expensive and uneconomical.

According to one idea, the piston speeds in the delivery cylinders are dimensioned differently, e.g. the suction speed is selected so much greater than the pumping speed that the suction stroke is ended early enough for the diverter to swivel as far as the center position between the two cylinders in the remaining time until the end of the pumping stroke. A plurality of phases are thereby passed through, in the first of which the cylinder opening of the previously sucking cylinder is closed by means of a shut-off element so that the pressurized concrete cannot flow back into the priming tank in any phase. Closing the cylinder opening additionally permits thick matter located in the cylinder to be precompressed to the operating pressure prevailing in the delivery pipe. In a further swivel phase the opening of the previously sucking cylinder is likewise connected with the delivery pipe, while the pumping stroke of the other cylinder is still ongoing. The cylinder filled with pre-compressed thick matter remains in this position (pump standby position) up to the end of the pumping stroke and then starts its own pumping stroke without a time delay and without a pressure drop in the delivery pipe, while in a third phase the opening of the previously pumping cylinder is initially closed by means of a further shut-off element (to avoid a short circuit). in a fourth and last phase the opening of said cylinder to the priming tank is released and the cylinder, or the piston of this cylinder, begins its suction stroke, again at a higher speed than that of the ongoing pumping stroke. The end of the suction stroke is followed by a new reversing process of the diverter, again while the pumping stroke in the reverse direction is still ongoing.

According to a furtherknown solution from the applicant, described in DE 29 09 964 to Schwing, each delivery cylinder is assigned its own diverter for controlling the suction and pumping stream while avoiding back flow and permitting precompression. A shut-off plate integrally formed as a shut-off element laterally on the inlet opening of the diverter prevents back flow and permits the precompression stroke. The outlet ends of the diverters open into a forked pipe whose outlet communicates with the delivery pipe. This pump is particularly worthy of improvement with respect to its overall width, constructional expense (two diverters, i.e. double material expense) and energy consumption (double expenditure of energy for the two swivel drives of the diverters).

The generic U.S. Pat. No. 3,663,129 proposes realizing the control of the thick-matter stream of a continuous-flow two-cylinder thick-matter pump with only one diverter. In contrast to DE 29 09 964, the pump of U.S. Pat. No. 3,663,129 has only one diverter passed by the pressurized stream, but its outsized inlet opening is problematic. It extends in an oblong shape over the arc of the swivel radius and must have a length corresponding to at least three times the diameter of the delivery cylinder openings since both cylinders must be connected with the delivery pipe in an intermediate phase (pump standby position of the previously sucking cylinder).

The high forces occurring at the usual high operating pressures cannot be absorbed by this diverter and the priming tank receiving the diverter, except with extremely great wall thickness. This is exacerbated by the fact that very high inertia forces and moments also result from the necessary short swivel times over the long shifting paths. From a static point of view as well, the excess weight of the usually mobile pumps resulting from the great wall thickness is unacceptable, as are the high costs.

The invention therefore aims to provide a continuous-flow two-cylinder thick-matter pump with low constructional expense.

The invention achieves this goal by the subject of claim 1.

Continuous-flow thick-matter pumps known from the prior art have in common that their development has long kept to disposing the diverter in the bottom area of the priming tank in the usual way and giving the diverter the function of guiding the pumping (pressurized) stream from the cylinders to the delivery pipe. The invention surprisingly takes a different path because it disposes the diverter between the suction side of the delivery cylinders and the suction pipe and separates the priming tank functionally from the diverter housing. The invention thus realizes a simple and compact diverter for controlling continuous thick-matter flow in a simple way. The inventive diverter thus requires only one circular opening with the diameter of the suction pipe at its end sweeping over the cylinder openings.

The invention further provides an especially compact arrangement wherein the diverter is disposed in a very small separate housing having a "minimal" geometry, so to speak, whereby the side lengths of the housing are only slightly longer than the diameter of the pipe and cylinder openings. The housing is constantly under delivery pressure, whereby the cavity between the outside contour of the diverter and the inside contour of the housing acts in a simple way as a pressure line and connects the particular pumping cylinder with the delivery pipe.

In contrast to the generic prior art (U.S. Pat. No. 3,663,129), the diverter is not disposed on the pumping side but on the suction side. This avoids the problems of an outsize design of the diverter outlet as a result of the high pressures in the delivery pipe as compared with the generic prior art.

It is known from DE-AS 16 53 614 to dispose a diverter controlling thick matter in a separate housing, the diverter guiding the thick-matter flow (suction stream) from the priming tank to the cylinders. However, the pump shown in this print is unsuitable for delivering thick matter continuously. To make this clearer, mention is first made of Swiss patent application CH 8986/61 or U.S. Pat. No. 3,146,721 which show the prior art DE-AS 16 53 614 wants to improve. CH 8986/61 describes a hydraulic piston pump for delivering viscous, pulpy or plastic materials. The piston pump comprises a cylindrical valve slide with two actuate channels which rotate to connect the material inlet and the material outlet alternately with one of the delivery cylinders. The material flow necessarily comes to a temporary standstill when the valve slide is located in an intermediate position.

DE-AS 16 53 614 wants to improve this prior art by providing a rotary slide valve for a sludge pump with no temporary interruption occurring in the material stream. The solution of DE-AS 16 53 614 achieves this by a cuplike valve box with three openings in the side wall and by a cuplike valve gate whose bottom part is located in the vicinity of the bottom part of the valve box and has two wings. The cup-like valve gate connects a priming tank with one of the cylinders at a time. The cup-like valve gate is thus in the widest sense a "diverter" disposed on the suction side. But this diverter only prevents material from standing still temporarily under the pressure effect upon disturbances in the synchronism between valve slide and delivery cylinder (apparently a control problem of that time) because the material outlet constantly remains open. Continuous pumping is not possible, nor is it mentioned anywhere in the print. For example, with knowledge of the present invention it is clear that the suction side of the valve of DE 16 53 614 is lacking a shut-off element for preventing back flow.

BRIEF SUMMARY OF THE INVENTION

The present invention, in contrast provides the generic thick-matter pump with a reversing valve whose diverter is connected on the suction side but which nevertheless permits continuous pumping. This is due to, among other things, the additional shut-off element for closing the suction pipe and/or the first and/or second openings of the diverter housing, which reliably prevents thick matter from flowing back into the suction pipe or even into the priming tank. This measure is not known from DE 16 53 614.

A further problem of DE 16 53 614 is that the shown valve is heavy and extremely costly in terms of material. This is another reason why the idea of DE 16 53 614, i.e. the idea of a suction-side diverter, was never taken up to realize a continuous-flow pump.

The combined features of claim 1, however, make it possible to realize a very compact reversing valve whose geometric dimensions can be astonishingly minimized. One reason for this is that no great pressure differences occur on the shut-off elements of the reversing valve to load said components excessively. During reversal there are ideally no pressure differences at all on the shut-off elements.

To control the pump or its valve one preferably uses the abovementioned method, making the piston speeds in the delivery cylinders different and selecting the suction speed so much greater than the pumping speed that the suction stroke is ended early enough for the diverter to already start swiveling in the remaining time up to the end of the pumping stroke. A plurality of phases are again passed through. For details reference is made to the description of the figures.

Advantageous variants of the invention are stated in the subclaims.

BRIEF DESCRIPTION OF THE DRAWINGS

In the following the invention will be described more closely by embodiments with reference to the drawing, in which.

First the constructional design of the four different embodiments according to FIGS. 1, 3, 5 and 7 will be described.

DETAILED DESCRIPTION

Figure 1A:
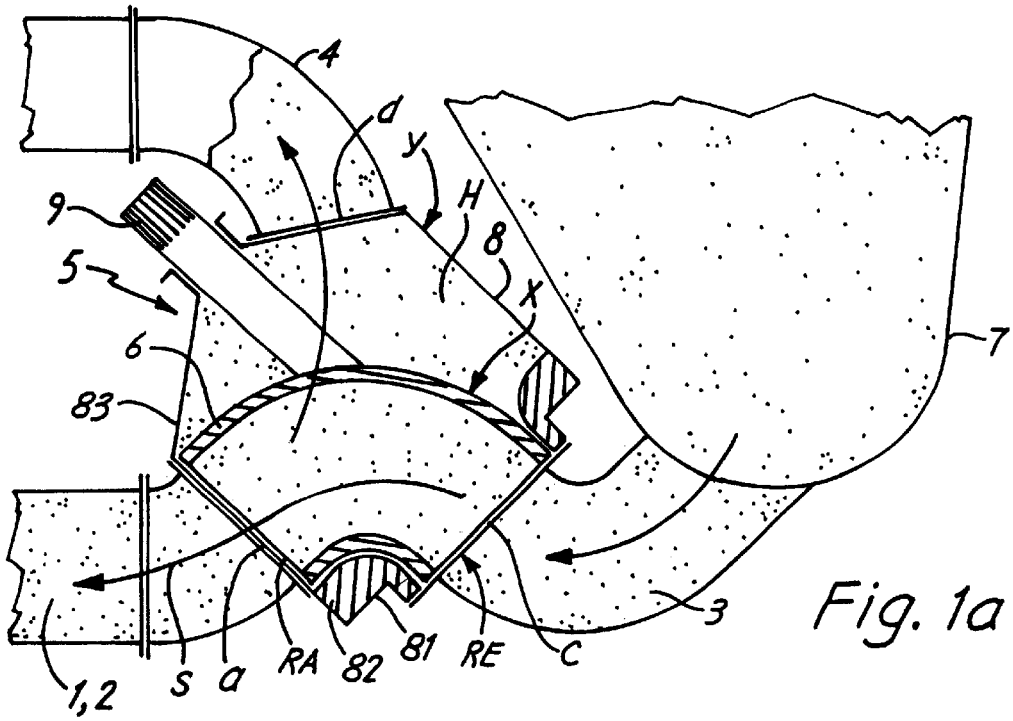
FIGS. 1*a* and *b* show different views of a reversing valve of a first embodiment of the invention with an L-shaped diverter.
Figure 1B:
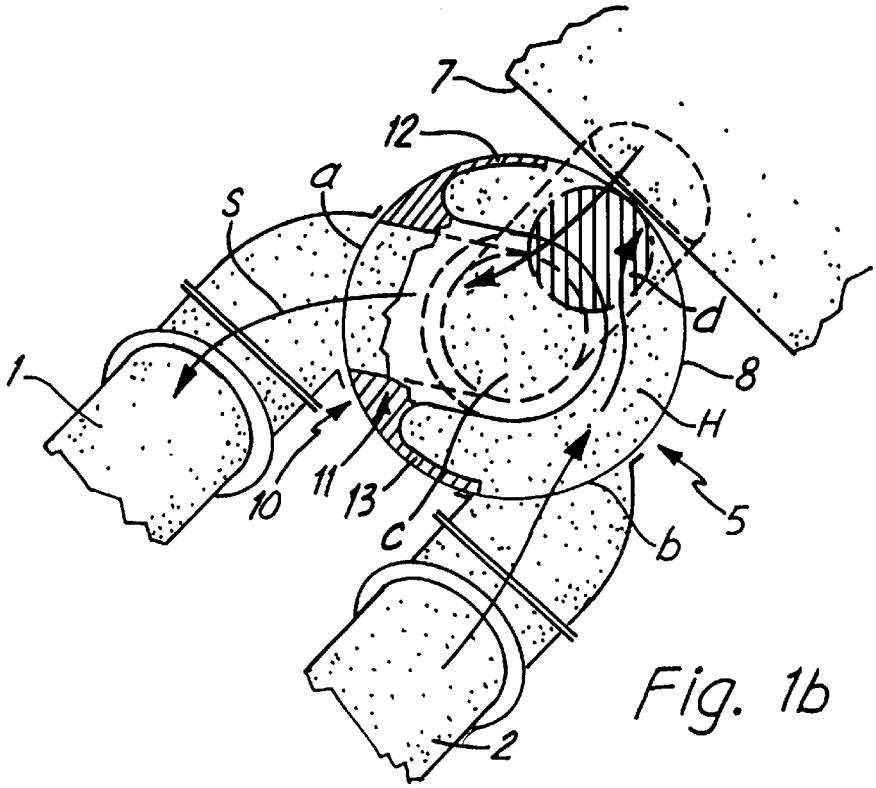
Figure 2A:
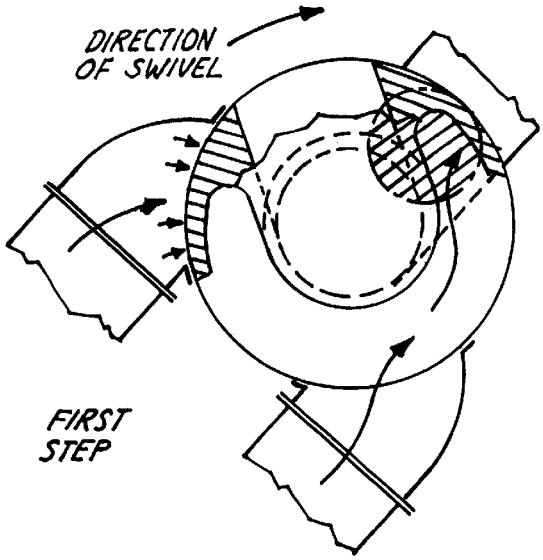
FIGS. 2*a* to *d* show different phases of the shifting cycle of the reversing valve from FIG. 1.
Figure 2B:
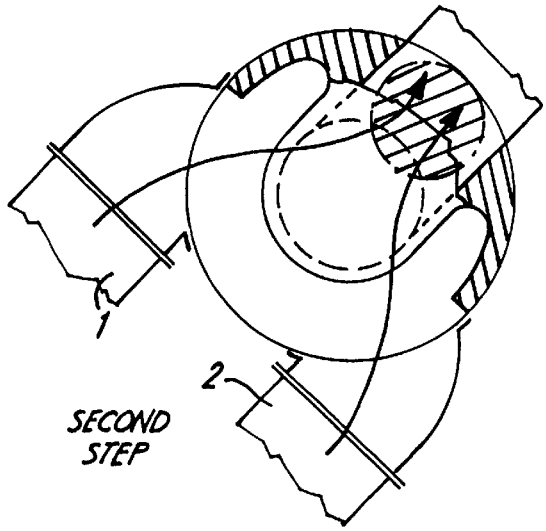
Figure 2C:
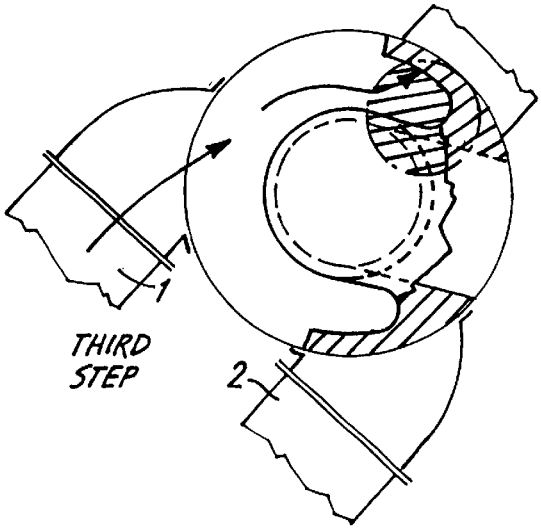
Figure 2D:
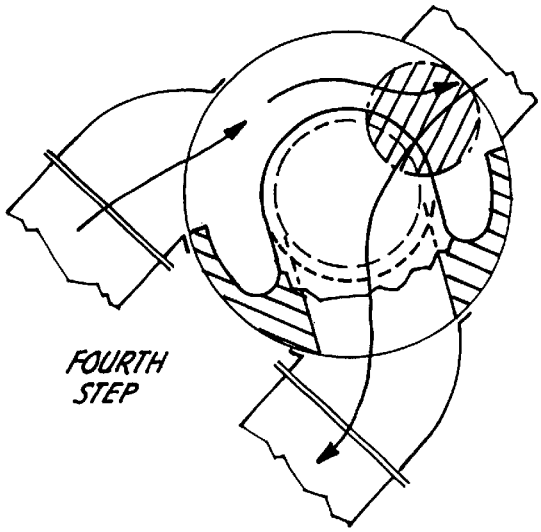

FIG. 1 shows a portion of a two-cylinder thick-matter pump for continuous delivery of thick matter, in particular for continuous delivery of concrete (shown by dots) which has two delivery cylinders 1, 2 (shown only rudimentarily) for delivering concrete from suction pipe 3 to delivery pipe 4.

Reversing valve 5 with diverter 6 is inserted between delivery cylinders 1, 2, suction pipe 3 and delivery pipe 4. Reversing valve 5 has separate diverter housing 8 (i.e. its own housing structurally separate from priming tank 7) with at least four openings a, b, c, d, the first and second openings a, b being connected to first and second delivery cylinders 1, 2, third opening c to suction pipe 3 and fourth opening d to delivery pipe 4. Diverter housing 8 further has stepped bottom part 81 in which third opening c is formed and into which suction pipe 3 opens, adjacent cylindrical base member 82 with openings a and b formed in the circumferential wall thereof, and conic cover portion 83 in which opening d is formed and to which delivery pipe 4 is connected.

Inlet opening RE (in the concrete flow direction indicated by arrow S) of L-shaped diverter 6 opens into third opening c of diverter housing 8 and is firmly connected with suction pipe 3. Outlet opening RA of diverter 6, however, swivels between first and second openings a, b for connecting delivery cylinders 1, 2 (or pieces of pipe preceding them). For the purpose of swiveling, driveshaft 9 is provided to which a drive unit (not shown) can be connected. Between the diverter's outside wall x and the housing's inside wall y there is cavity H which serves as a pressure line between the particular pumping delivery cylinder 1, 2 and delivery pipe 4 and which is constantly under delivery pressure during pumping.

Arcuate element 11 with two arcuate extensions 12, 13 on each side of diverter outlet opening RA is integrally formed on diverter 6 so as to form shut-off element 10 which lies against the inside wall of cylindrical portion 82 upon rotation of diverter 6 and can also release or close outlet openings a or b for connecting cylinders 1, 2.

Figure 3A:
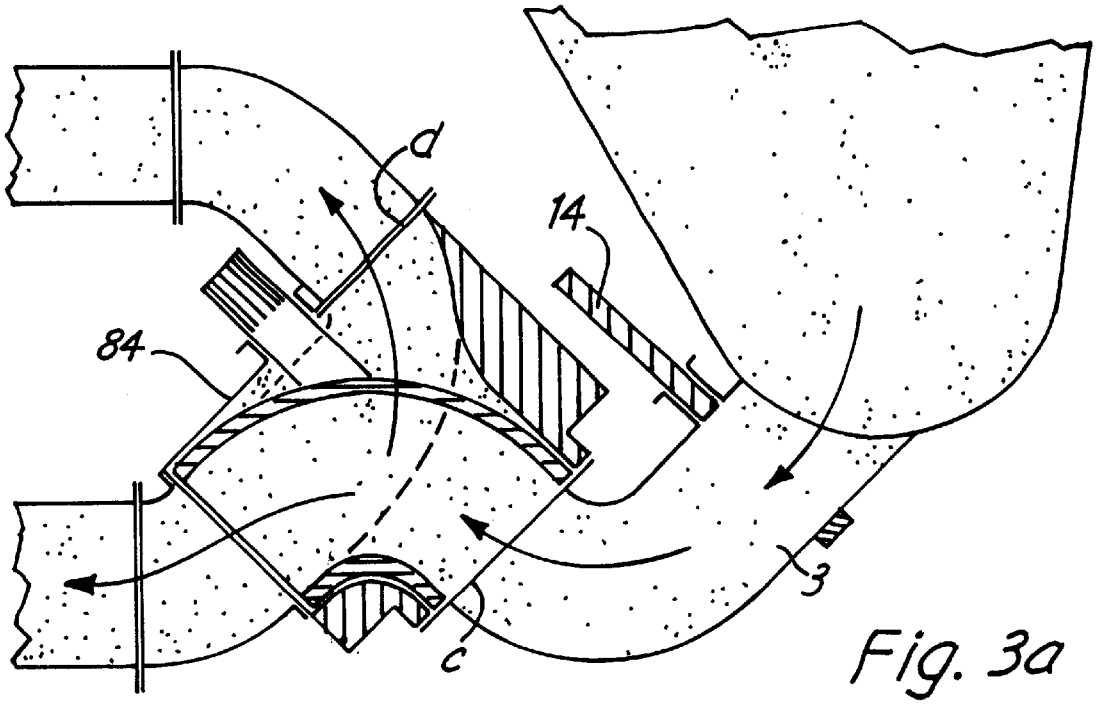
FIGS. 3*a* and *b* show different views of a reversing valve of a second embodiment of the invention with an L-shaped diverter.
Figure 3B:
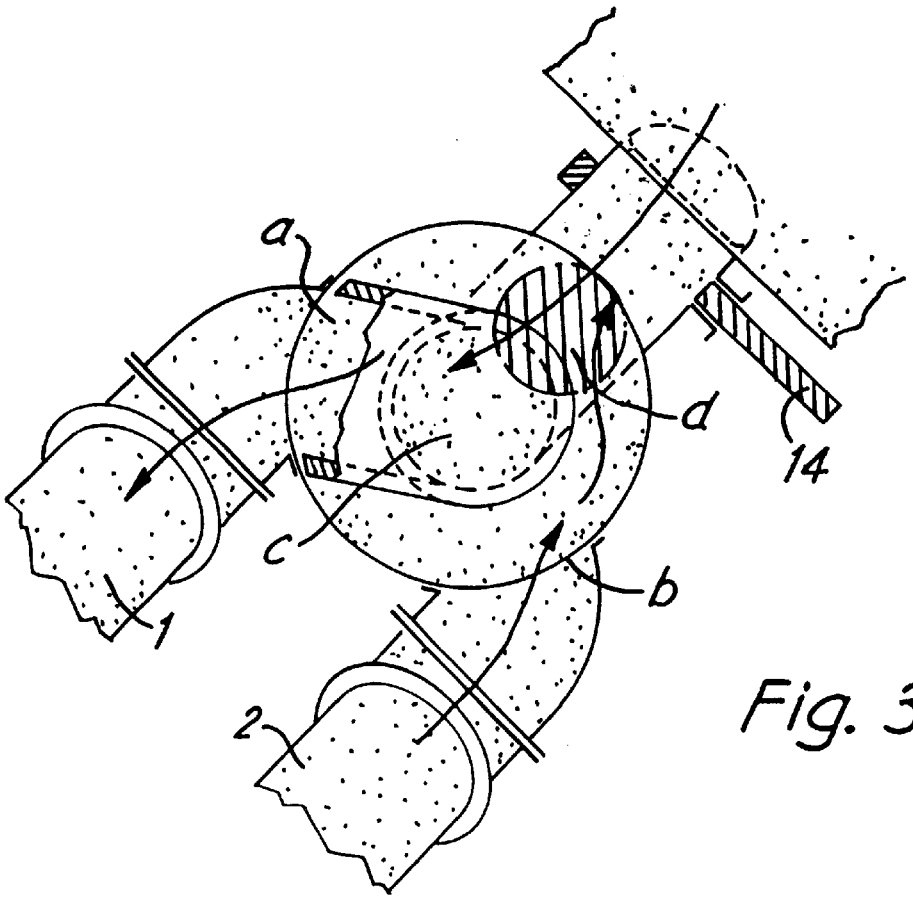

The embodiment of FIG. 3 differs from that of FIG. 1 substantially in that gate valve 14 is disposed in suction pipe 3 as a shut-off element instead of arcuate element 11. Gate valve 14 is a further constructional simplification of the invention because it eliminates the necessity of forming arcuate element 11. It is also less complicated to seal gate valve 14 than to seal arcuate element 11.

It is furthermore only necessary to be able to operate gate valve 14 separately and to generate control signals which close and open valve 14 in accordance with the individual pumping phases. This is no problem with the precision of modem control systems. Since valve 14 is only exposed to pressure differences in its end positions, it is also unproblematic to shift valve 14 without a pressure difference.

The use of gate valve 14 results in a further constructional advantage. This follows from the fact that diverter 6 can be provided with flat cover 84 instead of conic cover 83 from FIG. 1 because sufficient flow space now remains for the concrete in cavity H even with flat cover 84, in which opening d for connecting delivery pipe 4 is formed. This space is occupied in part by arcuate element 11 in the embodiment of FIG. 1. The embodiment of FIG. 3 is thus perhaps the optimum realization of the invention for a plurality of types of concrete because diverter housing 8 and diverter 6 are restricted to a fairly minimal size (in the area of the pipe diameters) and a few easily produced components.

Figure 5A:
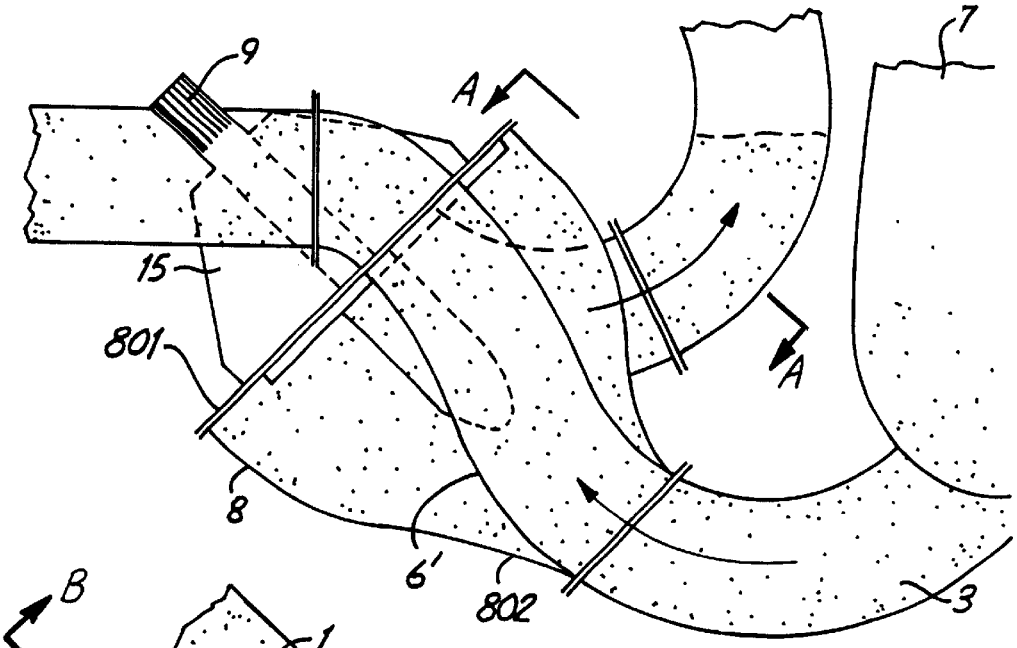
FIGS. 5*a* to *c* show different views of a reversing valve of a third embodiment of the invention with an S-shaped diverter.
Figure 5B:
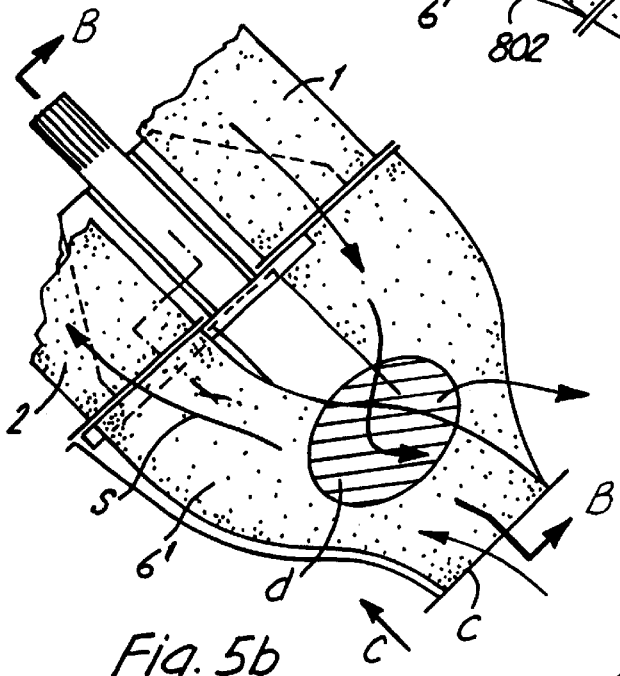
Figure 5C:
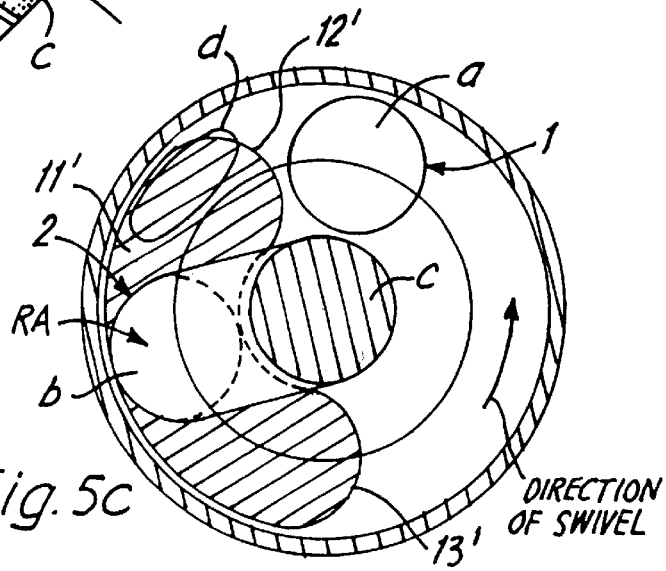

FIG. 5 shows an embodiment analogous to FIG. 1 but using S-shaped diverter 6' instead of L-shaped diverter 6. Diverter 6' is preferred with different types of concrete since different flow conditions prevail therein compared to more sharply curved L-shaped diverter 6. The diverter housing is formed here in accordance with the S shape of diverter 6' it quasi adapts to the S shape in its outside contour and tapers from flat cover portion 801 in the area of quasi "conic" housing portion 802. Openings a, b are formed in cover portion 801 and openings c and d for the delivery pipe are provided in housing portion 802. At its end opposite cover portion 801 portion 802 tapers down to the outside diameter of the diverter or the diameter of opening d for connecting suction pipe 3. Cover portion 801 is stabilized by several (e.g. 10 or more) ribs 15 formed between cover portion 801 and driveshaft 9.

As in FIG. 1, "arcuate element" 11' again serves as a shut-off element in FIG. 5 (see also FIG. 6), being formed here as a discoid arc and again having extensions 12' and 13' on each side of diverter outlet opening RA. Driveshaft 9 again rotates diverter 6 and arcuate element 11' integrally formed thereon.

Figure 7A:
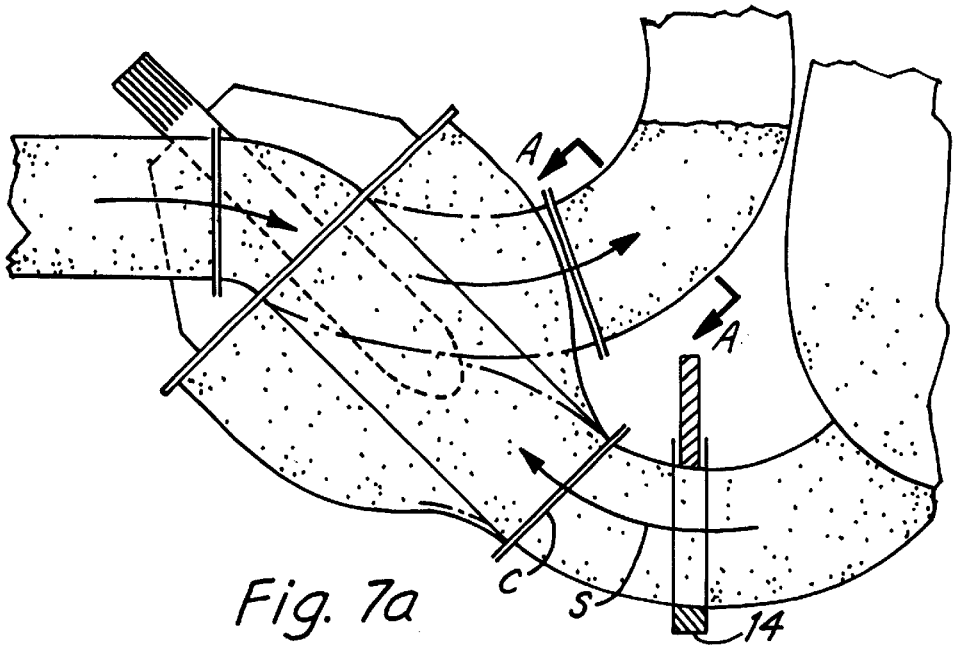
FIGS. 7*a* to *c* show different views of a reversing valve of a fourth embodiment of the invention with an S-shaped diverter.
Figure 7B:
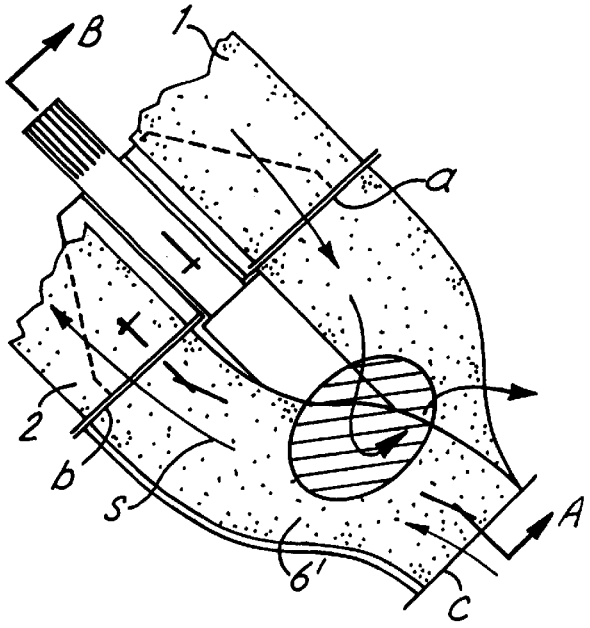
Figure 7C:
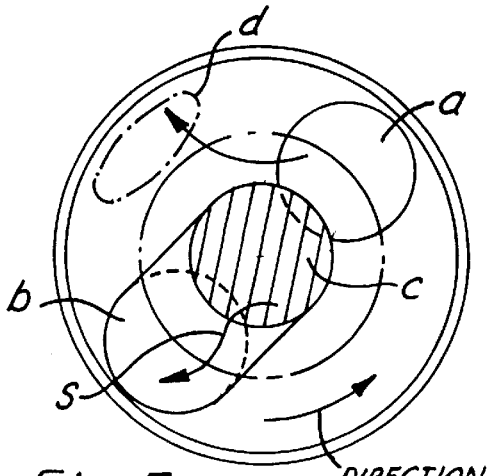
Figure 8A:
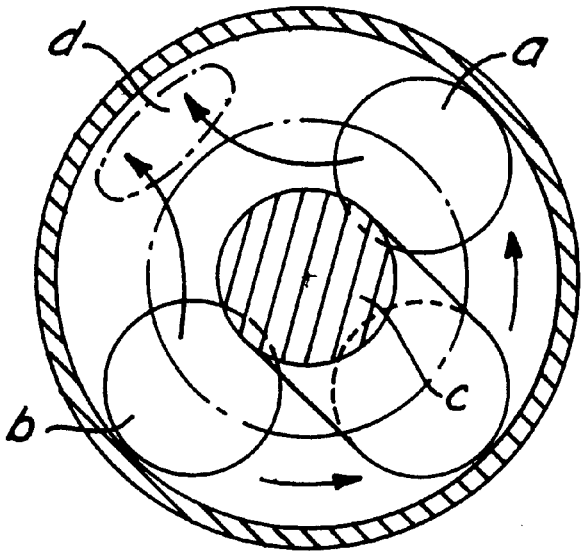
FIGS. 8*a* and *b* show two phases of the shifting cycle of the reversing valve from FIG. 7.
Figure 8B:
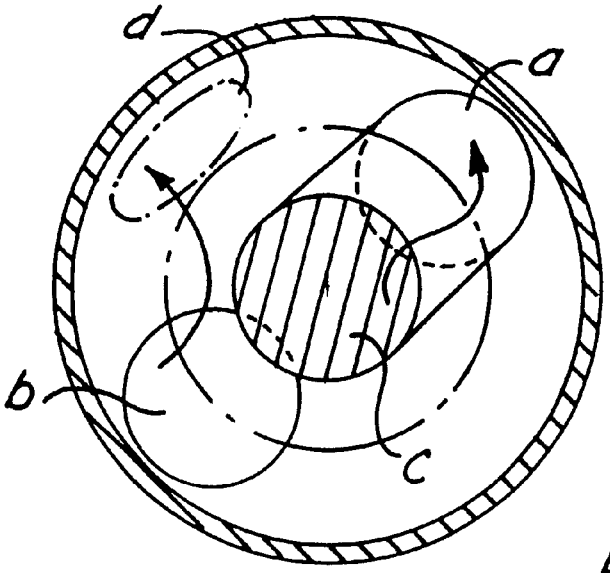

The embodiment of FIG. 7 largely corresponds in its structure to the embodiment of FIG. 5 because an S-shaped diverter is again used. As in FIG. 3, however, gate valve 14 is again disposed in suction pipe 3 as a shut-off element instead of arcuate element 11'. One again has the advantages of dispensing with a more elaborate shut-off element in an arc shape and easier sealing.

In the following the mode of operation of the inventive pump will be explained with reference to FIGS. 2, 4, 6 and 8. Reference is first made to FIGS. 2 and 6 which are analogous to each other with respect to the sequence of their shifting cycles (as are FIGS. 4 and 8, on the other hand).

The mode of operation of the concrete pump or the reversing valve adopts the idea of different piston speeds of sucking and pumping delivery cylinders 1, 2. The suction speed is again selected so much greater than the pumping speed that the suction stroke is ended early enough for diverter 6 to already start swiveling in the remaining time up to the end of the pumping stroke.

The four essential phases or steps of shifting can be seen especially well in FIG. 6. In the first phase (FIG. 6*a*) the cylinder opening of delivery cylinder 2 (which previously performed a suction stroke) is already covered by extension 12' of arcuate element 11', diverter outlet opening RA is closed by cover portion 801. This prevents concrete from flowing back from cylinder 2 into suction pipe 3 or priming tank 7. Closing cylinder opening b additionally permits precompression of thick matter located in cylinder 2 to the operating pressure prevailing in delivery pipe 4. Meanwhile the other cylinder still pumps thick matter through diverter housing 8 into delivery pipe 4.

The diverter then rotates into a position (FIG. 6*b*) in which both delivery cylinders 1 and 2 are connected with the interior of the diverter housing. The pumping stroke of cylinder 1 is still ongoing while cylinder 2 rests with its precompressed content and has assumed a pump standby position since its opening to cavity H is released; suction pipe 3 remains closed off because the diverter lies with its cylindrical outlet opening RA against cover 801.

Figure 6A:
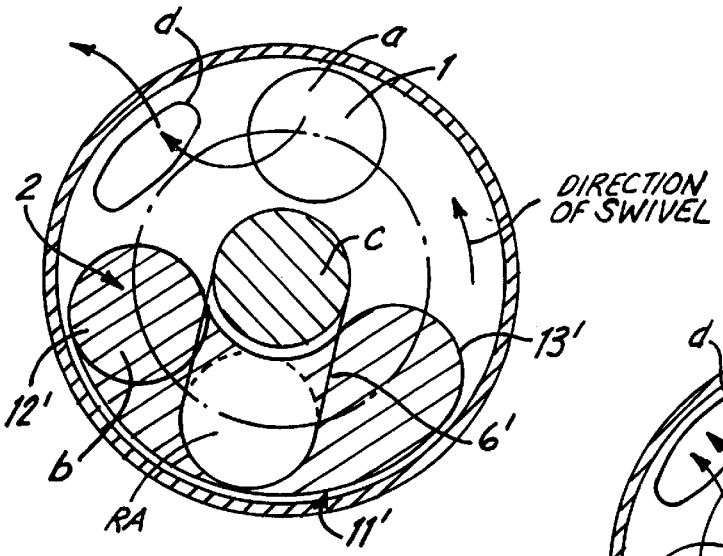
FIGS. 6*a* to *d* show the four different phases of the shifting cycle of the reversing valve from FIG. 5.
Figure 6B:
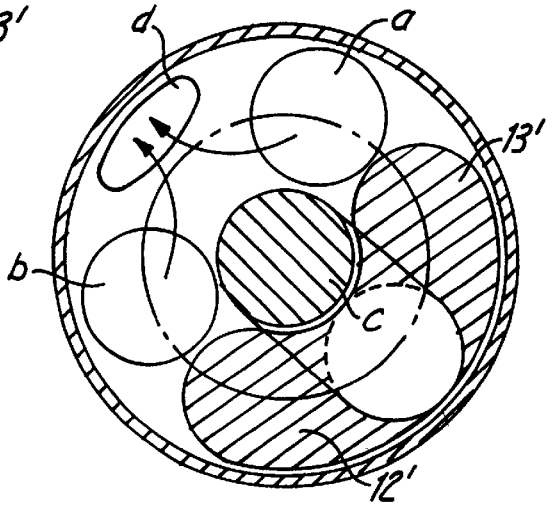
Figure 6C:
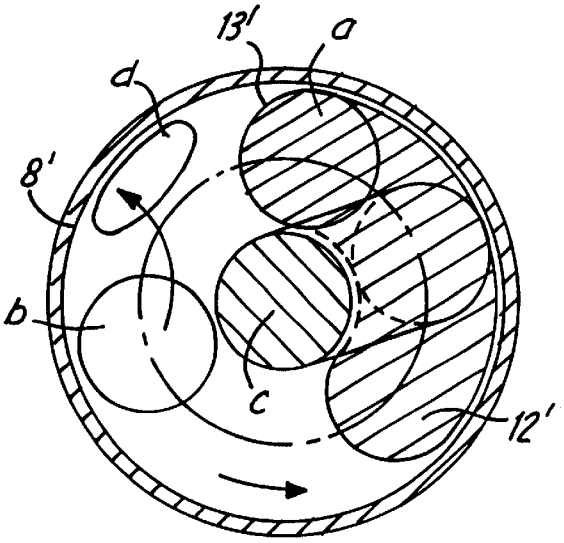
Figure 6D:
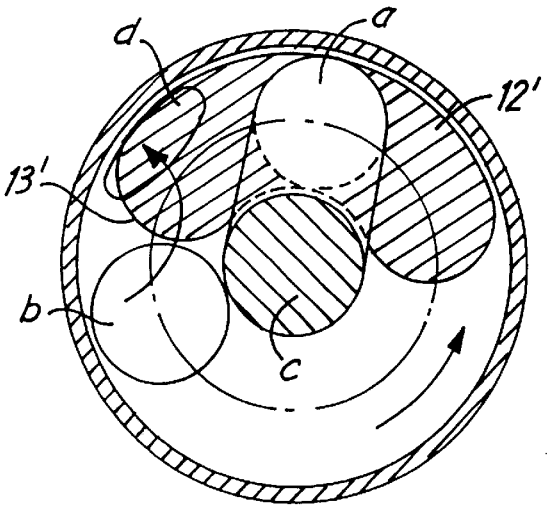

In a third step (see FIG. 6*c*), delivery cylinder 2 in turn starts the pumping stroke from its pump standby position without a time delay and without a pressure drop in delivery pipe 4, while opening a of previously pumping cylinder 1 is closed by means of extension 13' of shut-off element 11' in the third phase (FIG. 6*c*). The diverter outlet opening is also still closed.

In a fourth and last phase (FIG. 6*d*), the opening of cylinder 1 to suction pipe 3 or to priming tank 7 is released and the piston of delivery cylinder 1 begins its suction stroke, again at a higher speed than that of the ongoing pumping stroke (see FIG. 6*d*), as taught in the prior art. The end of the suction stroke is followed, again while the pumping stroke is still on-going in the reverse direction, by a new reversing process of diverter 6 into the position relative to delivery cylinder 1 analogous to FIG. 6*a*.

Figure 4A:
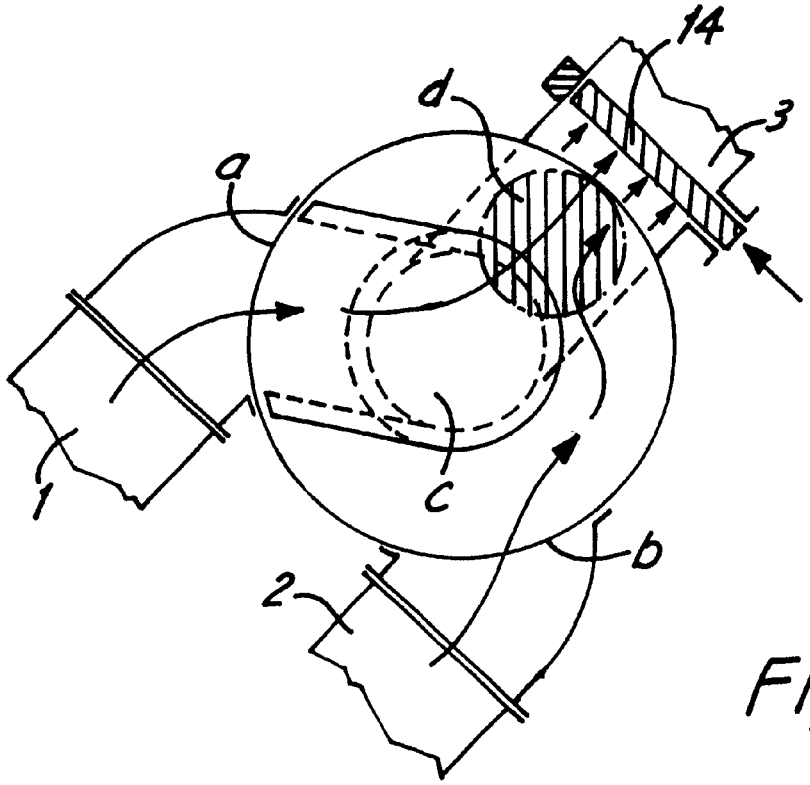
FIGS. 4*a* to *d* show the four different phases of the shifting cycle of the reversing valve from FIG. 3.
Figure 4B:
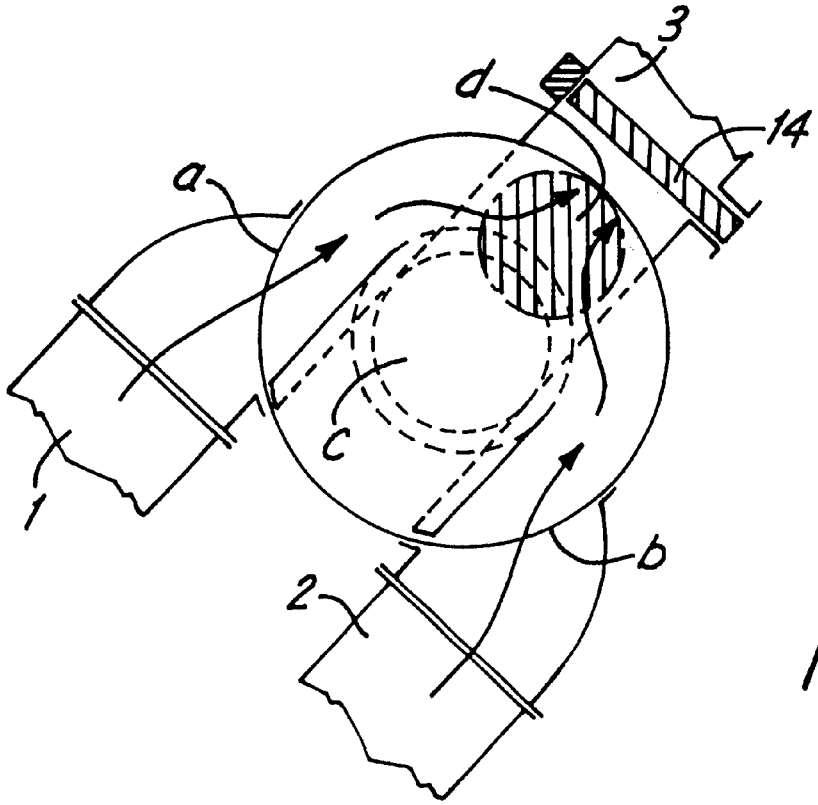
Figure 4C:
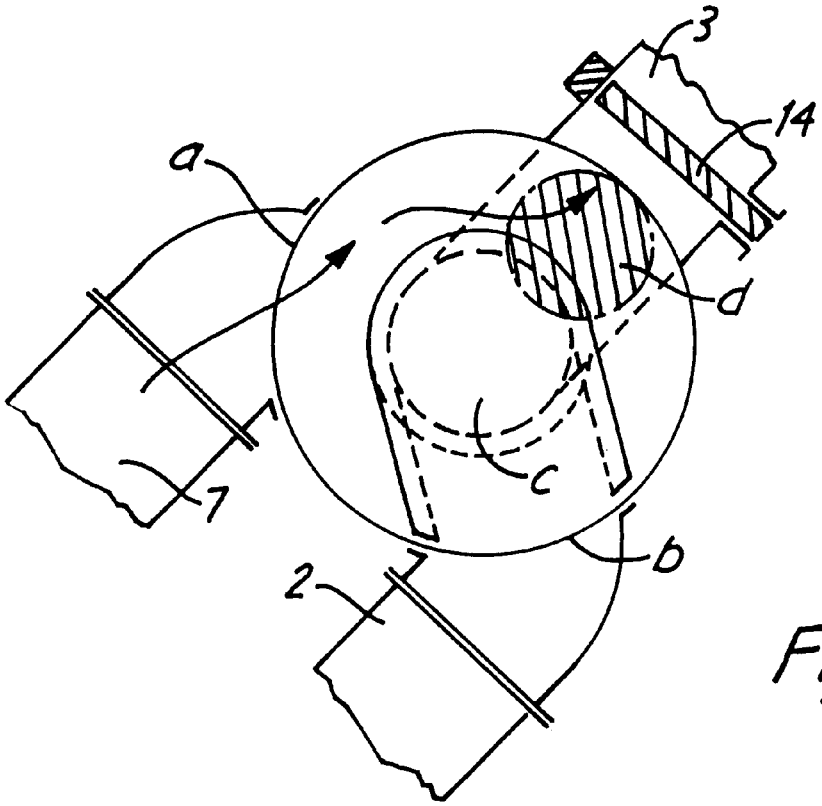
Figure 4D:
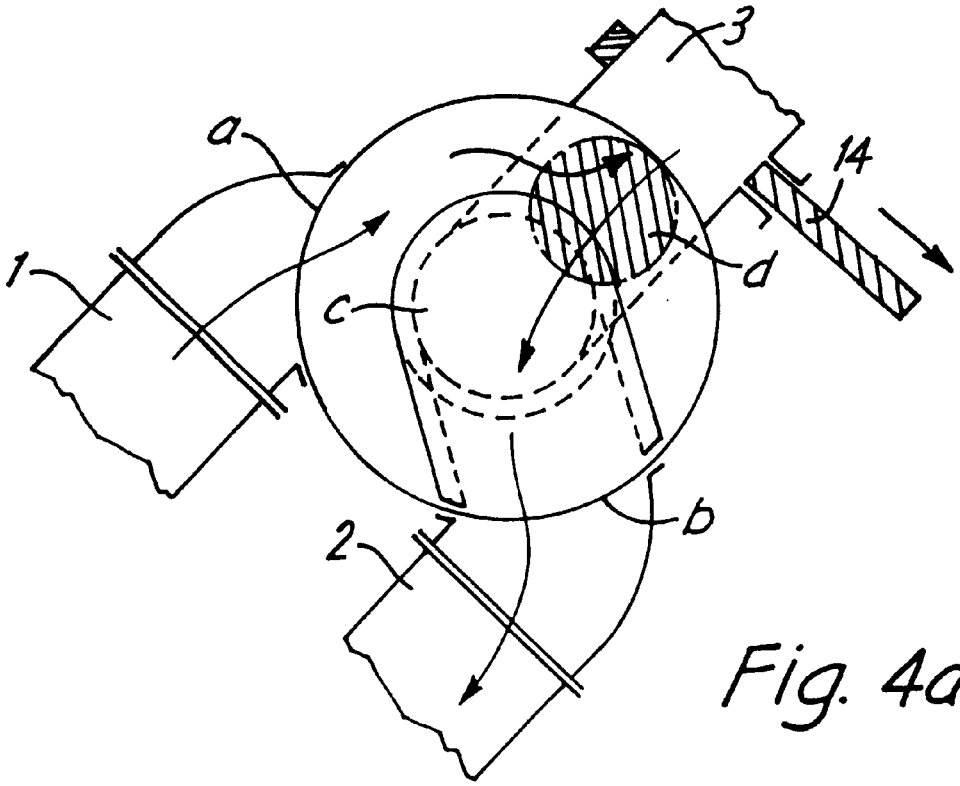

In the operation of the embodiments with gate valves 14 instead of arcuate elements 11 and 11' the only difference is that gate valve 14 closes with step one (FIG. 4*a*, first phase), remains closed during steps two and three (FIGS. 4*b* and 4*c*, second and third phases), and opens again during the suction phase with the fourth and last step (FIG. 4*d*, fourth phase).

| List of reference signs | |
|---|---|
| Delivery cylinders | 1, 2 |
| Suction pipe | 3 |
| Delivery pipe | 4 |
| Reversing valve | 5 |
| Diverter | 6, 6' |
| Priming tank | 7 |
| Diverter housing | 8, 8' |
| Driveshaft | 9 |
| Shut-off element | 10 |
| Arcuate elements | 11, 11' |
| Arcuate element extensions | 12, 13, 12', 13' |
| Gate valve | 14 |
| Ribs | 15 |
| Openings | a, b, c, d |
| Diverter's outside wall | x |
| Housing's inside wall | y |
| Flow direction (suction) | S |
| Cavity | H |
| Inlet opening of diverter | RE |
| Outlet opening of diverter | RA |
| Elements of various diverter housings: | |
| Stepped bottom part | 81 |
| Cylindrical base member | 82 |
| Conic cover portion | 83 |
| Flat cover | 84 |
| Cover portion | 801 |
| Housing portion | 802 |

What is claimed is:

1. A two-cylinder thick-matter pump for continuous delivery of thick matter, in particular for continuous delivery of concrete, which has in particular two delivery cylinders for delivering thick matter out of a suction pipe into a delivery pipe and a reversing valve with a swiveling diverter for reversing between the first and second delivery cylinders, characterized in that a) the reversing valve has a diverter housing with at least four openings, the first and second openings being adapted to be connected to the first and second delivery cylinders, the third opening to the suction pipe and the fourth opening to the delivery pipe, b) the diverter disposed in the diverter housing has an inlet opening which opens into the third opening of the diverter housing and is firmly connected with the suction pipe and an outlet opening which swivels between the first and second openings for connecting the delivery cylinders, and during changeover of the diverter from providing fluid communication with the first delivery cylinder to providing fluid communication with the second delivery cylinder, both the first delivery cylinder and the second delivery cylinder are momentarily in simultaneous fluid communication with the outlet opening, c) between the diverter's outside wall and the diverter housing's inside wall there is a cavity which forms the pressure line providing fluid communication between the particular pumping delivery cylinder and the delivery pipe, the cavity being constantly under delivery pressure from at least one delivery cylinder and during changeover of delivery cylinders being under delivery pressure from both delivery cylinders, and d) at least one shut-off element is provided for closing one or more of the suction pipe, the first opening, and the second opening of the diverter housing.

2. A two-cylinder thick-matter pump according to claim 1, characterized in that the diverter is formed as an L-pipe.

3. A two-cylinder thick-matter pump according to claim 2, characterized in that the diverter housing has a substantially cylindrical portion which is closed by a flat or conic cover.

4. A two-cylinder thick-matter pump according to claim 3, characterized in that the first and second openings are formed in the wall of the cylindrical portion, and the third and fourth openings are formed in the opposite cover portions.

5. A two-cylinder thick-matter pump according to claim 1, characterized in that the diverter is formed as an S-pipe.

6. A two-cylinder thick-matter pump according to claim 5, characterized in that the housing has an almost conic housing portion adapted substantially to the S shape of the diverter and closed by a flat cover portion.

7. A two-cylinder thick-matter pump according to claim 6, characterized in that the housing portion tapers at its end opposite the cover portion down to the outside diameter of the diverter or the diameter of the opening for connecting the suction pipe.

8. A two-cylinder thick-matter pump according to claim 6, characterized in that the cover portion is stabilized by a plurality of ribs formed between cover portion and drivesbaft.

9. A two-cylinder thick-matter pump according to claim 5, characterized in that the first arid second openings are formed in the cover portion and the third and fourth openings are formed in the housing portion.

10. A two-cyinder thick-matter pump according to claim 1, characterized in that at least one of the shut-off elements is formed as an arcuate element having on each side of the cylindrical outlet opening of the diverter arcuate extensions formed so as to be able to close the first and/or second openings.

11. A two-cylinder thick-matter pump according to claim 10, characterized in that the arcuate element is integrally formed on the diverter's outside wall so that it is corotated by rotations of the diverter.

12. A two-cylinder thick-manter pump according to claim 10, characterized in that the arcuate element lies with a discoid or a cylindrical surface against the diverter housing's inside wall.

13. A two-cylinder thick-matter pump according to claim 1, characterized in that at least one of the shut-off elements is formed to shut off the suction pipe.

14. A two-cylinder thick-matter pump according to claim 13, characterized in that the shut-off element is a gate valve.

15. A two-cylinder thick-matter pump according to claim 1, characterized in that the diverter housing is formed so as to be spatially separate from a priming tank.

* * * * *

UNITED STATES PATENT AND TRADEMARK OFFICE

CERTIFICATE OF CORRECTION

PATENT NO. : 6,450,779 B1
DATED : September 17, 2002
INVENTOR(S) : Friedrich Schwing It is certified that error appears in the above-identified patent and that said Letters Patent is hereby corrected as shown below:

Title page, Item [54] and Column 1, line 1,
Title, delete "TWO-CYLINDER THICK MATTER PUMP" and insert
-- THICK MATTER PUMP WITH OSCILLATING SUCTION VALVE --

Title page,
Item [56], References Cited, FOREIGN PATENT DOCUMENTS, delete "DE 20 09 964 9/1980" and insert -- DE 29 09 964 9/1980 --

Column 2,
Line 41, delete "furtherknown" and insert -- further known --

Signed and Sealed this

Sixth Day of April, 2004

JON W. DUDAS
*Acting Director of the United States Patent and Trademark Office*